United States Patent [19]

Carp

[11] 4,161,201

[45] Jul. 17, 1979

[54] COMBINATION CARRYING CASE AND ARTICLE ORGANIZER ASSEMBLY

[75] Inventor: Bess Carp, Detroit, Mich.

[73] Assignee: Joseph Carp, Detroit, Mich. ; a part interest

[21] Appl. No.: 919,819

[22] Filed: Jun. 28, 1978

[51] Int. Cl.[2] ..... A45C 13/02

[52] U.S. Cl. ..... 150/35; 150/34; 190/51

[58] Field of Search ..... 190/48, 51; 150/30, 150/34, 35

[56] References Cited

U.S. PATENT DOCUMENTS

| | | | |
|---|---|---|---|
| 2,527,059 | 10/1950 | Di Mezza | 150/35 |
| 2,612,199 | 9/1952 | Schocket | 150/34 |
| 3,533,459 | 10/1970 | Ody | 150/34 |
| 3,963,102 | 6/1976 | Carp | 190/51 |

*Primary Examiner*—Donald F. Norton

*Attorney, Agent, or Firm*—Cullen, Sloman, Cantor, Grauer, Scott, & Rutherford

[57] ABSTRACT

In combination with a carrying case having a chamber, there is provided an article organizer removably enclosed therein. The organizer comprises a first upright wall with a bottom wall along one edge hinged thereto as an extension thereof. An upright second wall is hinged to the other edge of the bottom wall as an extension thereof. Upright end walls are hinged to opposite ends of the first side wall as extensions thereof. Foldable flaps extend from the other side of each end wall adapted for securing to the second side wall, employing snap fasteners. A series of article storage pockets are arranged upon the interiors of said side and end walls, and upon the exterior of said side walls, said side, end and bottom walls adapted to lie in a single plane to facilitate selective filling of said pockets. Said series of pockets all cooperating to provide the traveler with a convenient, readily and easily accessible storage for most of the personal articles normally carried.

20 Claims, 9 Drawing Figures

FIG. 1
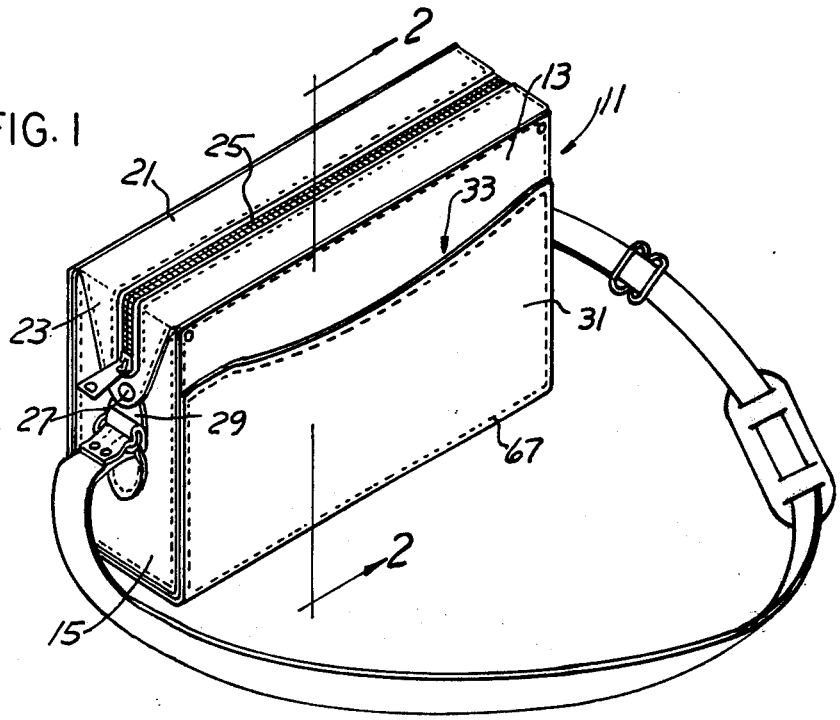
FIG. 2
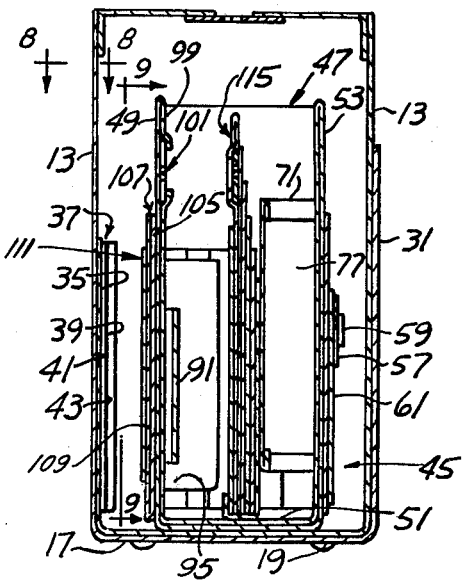
FIG. 3
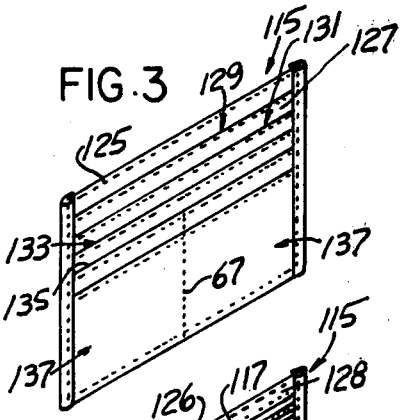
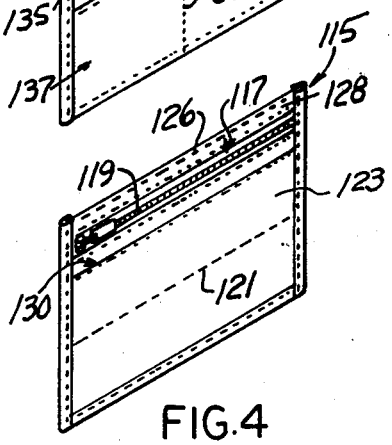
FIG. 4

FIG. 7
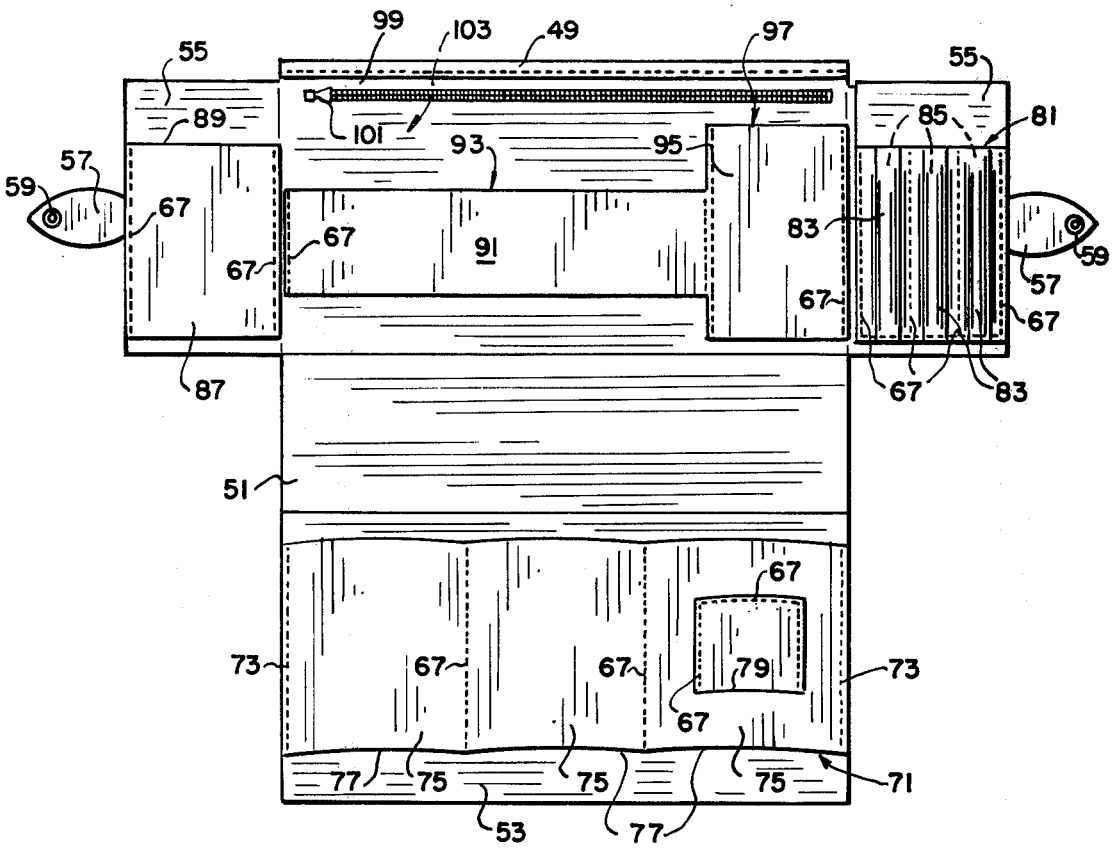
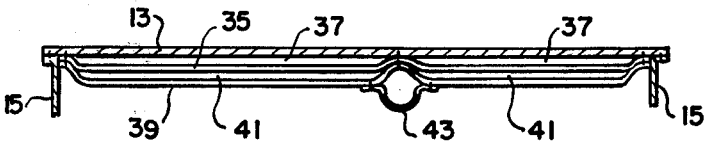
FIG. 8
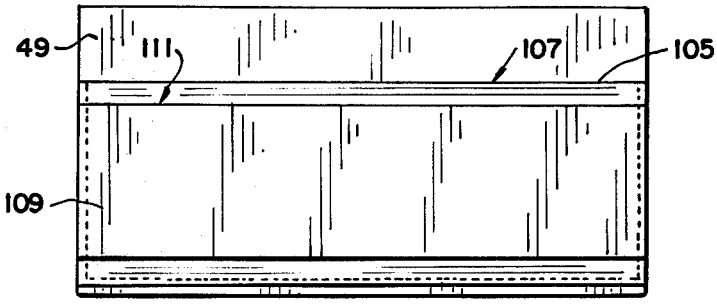
FIG. 9

COMBINATION CARRYING CASE AND ARTICLE ORGANIZER ASSEMBLY

BACKGROUND OF THE INVENTION

There has long existed the need for a complete type of carrying case, such as may be used by a traveler and wherein, provision is made for this separate and easy access to a series of personalized articles normally carried by such traveler. In most cases, purses and storage devices have been provided which have only limited storage capacity and wherein, items as a group are stored rather than individually.

Heretofore, there has been designed and patented by the present inventor a combination carry-on luggage bag with limited storage areas and adapted to store a tote bag, itself having storage areas within which a clutch bag may be stored to facilitate travel. Such construction is shown in Applicant's U.S. Pat. No. 3,963,102 entitled Combination Carry-On Luggage Bag With Tote Bag And Clutch Bag.

SUMMARY OF THE INVENTION

It is an object of the present invention to provide an improved carrying case, particularly useful for travelers and which has a storage chamber therein within which is removably stored an article organizer or devisor assembly. Thus, the articles a woman carries in her handbag can be reached with the tips of her fingers.

It is a further object to provide an article organizer assembly which has upright first and second side walls, bottom walls and end walls which are respectively hinged and interconnected and wherein, a series of article storage pockets are provided upon the interiors of said side and end walls and upon the exterior of said side walls in a construction such that the side, end and bottom walls are adapted to lie in a single plane to facilitate selective filling of the respective pockets.

The organizer or divisor is an entity in itself. It can be removed intact and slipped into any other bag of her choice.

It is a further object to provide an all-purpose article organizer for use in conjunction with a carrying case of any desired type, having a chamber and wherein, the article organizer includes a series of side walls, end walls and a bottom wall and wherein, a plurality of different shape and different sized pockets, some open top and some open at both ends, are provided adjacent the respective side or end walls and are so arranged cooperatively as to provide for the traveler a convenient readily and easily accessible storage for most of the personal items normally carried.

These and other objects will be seen from the following specification and claims in conjunction with the appended drawings.

THE DRAWINGS

FIG. 1 is a perspective view of the present carrying case within which there is provided an article organizer.

FIG. 2 is a section taken in the direction of arrows 2—2 of FIG. 1, showing the article organizer in vertical section within said carrying case.

FIG. 3 is a perspective view of one side of a wallet adapted for storing within said organizer.

FIG. 4 is a similar perspective view of the opposite side of said wallet.

FIG. 7 is a plan view of the organizer of FIGS. 5 and 6 opened into a single plane.

FIG. 8 is a vertical sectional view of the carrying case taken in the direction of arrows 8—8 through the side wall 13 of FIG. 2.

FIG. 9 is a side elevational view of one exterior wall of the organizer, taken in the direction of arrows 9—9 of FIG. 2.

Figure 5:
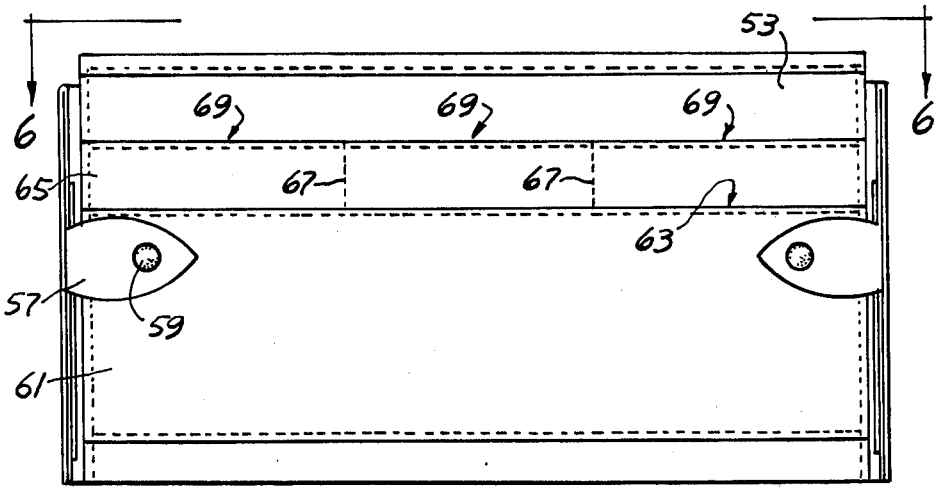
FIG. 5 is a side elevational view of the organizer shown in FIG. 2.

It will be understood that the above drawings illustrate merely a preferred embodiment of the invention and that other embodiments are contemplated within the scope of the claims hereafter set forth.

DETAILED DESCRIPTION OF THE INVENTION

A carrying case is generally indicated at 11, FIG. 1, constructed of leather, plastic or Naugahyde, vinyl or canvas and includes side walls 13, end walls 15, FIGS. 1 and 2, bottom wall 17 with legs 19 and opposed top closure flaps 21. The top closure flaps extend beyond the end walls and terminate in the downturned end flaps 23. These overlie upper portions of the end walls and are secured thereto by the snap fasteners 27. Top flaps 21 and portions of the end flaps are spaced apart and are connected by the zipper 25. Said snap fasteners are adapted for securing to a corresponding cooperating snap mounted upon the flexible anchor flaps 29 upon the respective end walls of the case.

As shown in FIG. 1, overlying one side wall 13 of the case is an elongated strip 31 of reduced height relative to said side wall and which is secured at its ends and along its bottom to corresponding portions of said side wall, as by stitching 67 to define an outer elongated pocket 33. The case walls define the storage chamber 45 within which is removably mounted organizer 47, FIGS. 2, 5 and 6.

Within said chamber and upon the interior of one side wall 13, FIG. 2, there is provided an elongated first strip 35 which is of less height than the corresponding wall and at its ends is secured to end portions of the side wall and intermediate its ends by upright stitching is further secured to said side wall to define a pair of upwardly opening storage pockets 37, adapted to selective store an address book and snapshots respectively, for illustration.

A second elongated inner strip 39 is of less height than the first strip, overlies said first strip and at its ends is secured to end portions of the first strip. Said second strip intermediate its ends has an open ended upright loop 43 formed therein, a portion of which is secured to the adjacent strip thereunder and adjacent wall by suitable stitching to thereby define a pair of inner open ended pockets 41 for the selective storage of a date book and for miscellaneous materials. Loop 43 defines a pocket open at its opposite ends adapted to receive and store a pen.

ARTICLE ORGANIZER ASSEMBLY

The present article divisor 47 includes FIGS. 2, 5 and 6 and 7, having a first upright side wall 49. Bottom wall 51, along one edge, is hinged to the first side wall as an extension thereof. The second upright side wall 53 is hinged at its lower end to the other edge of said bottom wall as an extension thereof. The respective end walls 55 are hinged at their one edges to opposite ends of the first side wall as extensions thereof. A foldable flap 57 extends from the other side of each end wall and is adapted to overly the second side wall 53 and is secured thereto respectively by the snap fasteners 59 which cooperatively engage corresponding fasteners upon the elongated side strip 61.

Said side strip 61 overlies the second upright side wall 53 for a portion of its height and is secured thereto at its ends by stitching and at the bottom thereof to corresponding end and bottom portions of the second upright side wall 53. This defines the outer storage pocket 63 which may be selectively used by the traveler for the storage of personal mail.

Inwardly of the strip 61 and parallel thereto is the inner strip 65 which overlies the second upright wall 53, is of less height than said upright wall though a greater height than strip 61 and is secured to the upright wall at the ends thereof and at a pair of spaced portions, intermediate the ends thereof as by the stitching 67 to define adjacent said upright wall a series of three storage pockets 69 open at their upper ends adapted for the selective storage respectively of business cards, a mirror, and credit cards.

Arranged upon the interior of the organizer side wall 53 is an elongated flexible liner strip 71, of less height than wall 53 having a series of loops 75 formed therein and secured as by stitching at 73 at its ends to end portions of the side wall 53 and intermediate its ends by the upright stitching 67. This defines a series of upright open-end pockets 77. Said pockets are adapted for selective storage therein by the traveler respectively of cigarettes, eyeglasses and sunglasses.

Figure 6:
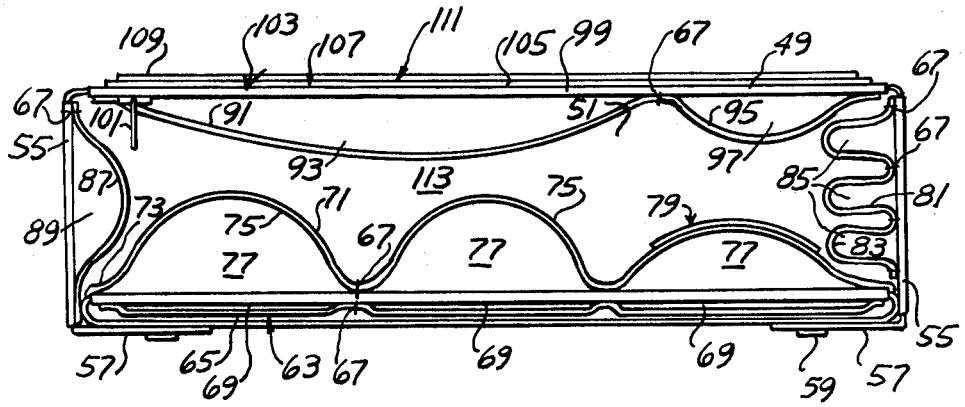
FIG. 6 is a plan view taken in the direction of arrows 6—6 of FIG. 5.

An additional upwardly opening pocket 79, FIG. 6, is applied to the interior surface of one of the pockets 77 to provide for the storage of a book of matches.

As shown in FIG. 6, there is arranged upon one of the end walls 55 a transverse flexible strip 81 which is formed into a series of upright loops 83 defining pockets 85. End portions of the strip 81 are secured to corresponding upright side edges of the corresponding end wall 55 as by the stitching 67. Likewise, intermediate portions of the respective loops 83 are similarly secured by the upright stitching 67 to said end wall. The lower edges of strip 81 are secured to end wall 55. This provides a series of open top storage compartments, of less height than the corresponding end wall adapted for the selective reception and storage for easy access of a container of perfume, lipstick, and a lighter, respectively.

Arranged upon the opposite end wall 55 of the organizer and extending transversely thereof for a portion of its height is an elongated flexible looped strip 87 anchored at its ends by the upright stitching 67 to end portions of the end wall to define an upright pocket 89 open at its top and bottom adapted for the selective storage of a comb and brush.

Upon the interior of the first upright wall 49 there is provided an elongated flexible inner strip 91 of less height than wall 49, at one end secured by stitching 67 to a corresponding end portion of side wall 49 and at its other end is secured by similar stitching to an intermediate upright portion of wall 49 to define the enlarged pocket 93 which is open at its top and bottom adapted for storing a checkbook.

An additional strip 95 of increased height is arranged at the end of the strip 91 and is secured at its sides and bottom to the interior of the upright wall 49 by stitches 67 to form open top pocket 97. Said pocket is adapted for the storage of a key ring and keys for convenient access to the traveler.

The interior surface of the upright wall 49 includes an inner wall strip 99 which is peripherally connected to edge portions of wall 49 to define a secure storage chamber 103. The strip 99 has a longitudinal slit adjacent its upper end as shown in FIG. 2 and there is applied thereto the zipper 101 for opening and closing said storage chamber. Said chamber is adapted for storage of travel papers.

The first side wall 49 has upon the exterior thereof a first elongated strip 105 of less height than wall 49 and secured at its sides and bottom to adjacent portions of the wall 49 to define an elongated pocket 107 for general storage purposes.

An additional elongated strip 109 overlies the first strip 105, is of less height than strip 105 and is secured to wall 49 by stitching along the sides and bottom thereof to corresponding portions of said wall. This defines an additional storage pocket 111 upon the exterior of the organizer which may be selectively used for the convenient storage of business mail, for illustration.

WALLET

The respective side walls 49 and 53 and the end walls 55 in conjunction with the bottom wall 51 define a storage chamber 113, FIG. 6, within said organizer within which is removably positioned the wallet 115 shown assembled in FIG. 2 and in perspective from opposite sides in FIGS. 3 and 4.

The wallet includes an upright strip having a front wall 125 and a back wall 126. Upon said back wall there is applied thereover a second strip 128 which is peripherally secured to said rear wall and intermediate its top and bottom is further connected to said rear wall by the stitching 121 to define a change purse 117. A portion of said second wall is slit adjacent its upper end and is opened and closed by the zipper 119.

A third strip 123 overlies the second strip 128, is of less height than strip 128 and is secured thereto and to the said back wall upon the sides and bottom thereof to define an additional storage pocket 130 adapted for holding receipts, for illustration.

Arranged from the front wall 125 of the strip as in FIG. 3 are a further series of elongated overlapped strips of progressive reduced height with respect to the front wall of said wallet. Each strip is secured peripherally at the edges and at the bottom to the corresponding edges and bottom of said front wall. A pair of the lowermost and outer strips are additionally secured as by upright stitching 67 to an adjacent strip thereunder.

The respective strips therefore shown in FIG. 3 define a series of pockets 129 for the storage of foreign currency, pocket 131 for the storage of U.S. currency, pocket 133 for storage of items pending, a pair of pockets 135 for the storage respectively of personal I.D. and a driver's license, and the lowermost pockets 137 for the selective storage of business or credit cards, and a parking lot ticket respectively.

There has, thus, been provided by the wallet a plurality of additional storage pockets, all cooperating for the convenience of the traveler and for the easy removal from the organizer and for convenient access to the articles stored within said pockets as described above in the illustrative embodiment.

The storage pockets provided by the overall assembly are listed hereunder for an overall picture of the availability and utility of the pockets provided, all of which cooperate for the use and convenience of the traveler and for the convenient and easy access of those articles normally and generally carried by travelers. For illustration:

Outer Case 11

Pocket 33—General for a newspaper, a map or a street guide or the like
Pockets 37—Address book, snapshots
Pockets 41—Datebook, miscellaneous
Pocket 43—A pen Organizer The following additional pockets:
63—Personal mail
69—Three pockets: business cards, credit cards, mirror
77—Three pockets: cigarettes, eyeglasses, sunglasses
79—Book of matches
85—Three pockets: perfume, lipstick, lighter
89—Pocket for Comb and brush
93—Checkbook pocket
97—Keys
103—Storage of travel papers and the like
107—General usage pocket
111—Business mail pocket
113—Chamber for a wallet.

Wallet

The following additional pockets:
117—Change purse
123—Receipts
129—Foreign currency
131—U.S. currency
133—Items pending
135—Two pockets for personal I.D. and driver's license, respectively
137—Two pockets: business cards or credit cards and parking tickets Having described my invention, reference should now be had to the following claims.

I claim:

1. In combination with a carrying case having a chamber;
an article organizer assembly removably enclosed within said chamber;
said assembly comprising an upright first side wall;
a bottom wall along one edge hinged thereto as an extension thereof;
an upright second side wall hinged to the other edge of the bottom wall as an extension thereof;
upright end walls on one side hinged to opposite ends of said first side wall as extensions thereof;
a foldable flap extending from the other side of each end wall adapted to overly said second side wall;
snap fasteners on each flap removably secured to a corresponding fastener upon said second side wall;
and a series of article storage pockets upon the interiors of each of said side walls and one end wall and a pocket upon the other end wall, said side, end and bottom walls adapted to lie in a single plane to facilitate selective filling of said pockets.

2. In the carrying case and article organizer assembly of claim 1, said series of pockets including a first strip overlying and peripherally secured to the interior of said first side wall defining a safety storage pocket, there being a longitudinal slit in said strip, and a zipper on said strip adjustable along said slit.

3. In the carrying case and article organizer assembly of claim 2, an elongated second strip upon and spaced inwardly of the interior of said first strip and of reduced height, with one end secured to the end of said first strip and with its other end secured to an intermediate portion of said first strip, to define an elongated pocket open at its top and bottom.

4. In the carrying case and article organizer assembly of claim 3, a pocket open at its top aligned with said second strip and secured to one end of said first strip, for key storage.

5. In the carrying case and article organizer assembly of claim 2, a series of open-top pockets of less height than and secured upon one of said end walls for the selective storage respectively of perfume, lipstick and a cigarette lighter.

6. In the carrying case and article organizer assembly of claim 5, and a loop strip overlying and spaced from the interior of and of less height than the other end wall with its ends secured to opposite sides of said end wall defining a pocket open at its top and bottom for the selective storage of a comb and brush.

7. In the carrying case and article organizer assembly of claim 6, an elongated strip upon and spaced from the interior of and of less height than said second side wall, and secured along upright lines at its ends to ends of said second wall and at a pair of sapced locations additionally secured to intermediate portions of said second wall for defining a series of looped compartments open at their top and bottom for the selective storage respectively of cigarettes, reading glasses and sun glasses.

8. In the carrying case and article organizer assembly of claim 2, an elongated strip upon and spaced from the interior of and of less height than said second side wall, and secured along upright lines at its ends to ends of said second wall and at a pair of spaced locations additionally secured to intermediate portions of said second wall for defining a series of looped compartments open at their top and bottom for the selective storage respectively of cigarettes, reading glasses and sun glasses.

9. In the carrying case and article organizer assembly of claim 8, an open top pocket of less height than and overlying and secured to the strip upon the interior of said second side wall adapted for storage of a book of matches.

10. In the carrying case and article organizer assembly of claim 8, a second strip upon the exterior of said first upright wall of reduced height relative to said first wall and at its ends and bottom secured to the ends of said first wall and adjacent the bottom wall of said first wall respectively; and a third strip of less height than and overlying said second strip and at its ends and bottom secured to said second strip, defining a pair of open top pockets along the length of said first side wall for the selective storage of business papers and mail respectively.

11. In the carrying case and article organizer assembly of claim 8, a first strip of less height than said second upright wall and secured to the ends thereof and at a pair of intermediate points to the exterior of said second upright wall defining a series of laterally aligned pockets for the selective storage respectively of business cards, a mirror and credit cards; and a second strip of less height than said latter first strip overlying and at its ends secured to said latter first strip and to said second wall, with the bottoms of both first and second strips secured to said second wall, for defining along the length of said second wall an elongated pocket for the storage of personal mail.

12. In the carrying case and article organizer assembly of claim 2, a second strip upon the exterior of said first upright wall of reduced height relative to said wall and at its ends and bottom secured to the ends of said first wall and adjacent the bottom of said first wall respectively; and a third strip of less height than and overlying said second strip and at its ends and bottom secured to said second strip defining a pair of open top pockets along the length of said first side wall for the selective storage of business papers and mail respectively.

13. In the carrying case and article organizer assembly of claim 2, a first strip of less height than said second upright wall and secured to the ends and at a pair of intermediate points to the exterior of said second upright wall defining a series of laterally aligned pockets for the selective storage respectively of business cards, a mirror, and credit cards.

14. In the carrying case and article organizer assembly of claim 13, and a second strip of less height than said latter first strip overlying and at its ends secured to said latter first strip and to said second wall, with the bottom of both first and second strips secured to said second wall for defining along the length of said second wall an elongated pocket for the storage of personal mail.

15. In the carrying case and article organizer assembly of claim 1, said carrying case including side walls, end walls and a pair of top closure flaps;

said flaps extending beyond the ends of said end walls and terminating in downturned end flaps adapted for registry with said end walls respectively;

said top flaps and portions of said end flaps being spaced apart;

a zipper interconnecting said top closure and end flaps;

and snap-fasteners upon the ends of said end flaps in removably securing registry with a corresponding snap fastener on each of said end walls.

16. In the carrying case and article organizer assembly of claim 1, said carrying case including a pair of side walls;

a first strip of less height than and upon the interior of one side wall along its length, at its ends and intermediate its ends and along its bottom secured to said one side wall defining a pair of pockets within said chamber adapted for the selective storage of an address book and snapshots respectively.

17. In the carrying case and article organizer assembly of claim 16, a second elongated strip of less height than and overlying said latter first strip at its ends secured to the ends of said latter first strip and intermediate the ends formed into an upright loop and secured to said latter first strip defining an additional series of pockets open at the top and bottom thereof for the selective storage respectively of a datebook, a pen, and miscellaneous items.

18. In the carrying case and article organizer assembly of claim 1, said organizer having a chamber;

and a wallet nested within said chamber;

said wallet including a strip having a front wall and back wall;

a second strip overlying said back wall and peripherally connected thereto and intermediate its height secured longitudinally thereto to define with said back wall a change purse;

said second strip having a longitudinal slit adjacent its top;

and a zipper along said slit for opening and closing said change purse;

and a third strip of less height than and overlying and secured to said second strip along its sides and bottom defining a pocket adapted to store receipts.

19. In the carrying case, article organizer assembly and wallet construction of claim 18, a plurality of additional strips overlying said front wall, each of progressively less height than said front wall, and secured thereto along their sides and bottom to the sides and bottom of said front wall;

a pair of the outermost strips being secured intermediate their ends to the next adjacent inner strip to thereby provide a series of cooperating pockets for the selective storage from the top to the bottom of said front wall, respectively of foreign currency, U.S. currency, items pending, personal I.D., driver's license, business and credit cards and parking tickets.

20. A travel wallet including a strip having front wall and back wall;

a second strip overlying said back wall and peripherally connected thereto and intermediate its height secured longitudinally thereto to define with said back wall a change purse; said second strip being longitudinally slit adjacent its top; and a zipper along said slit for opening and closing said change purse;

and a third strip of less height than and overlying and secured to said second strip along its sides and bottom defining a pocket adapted to store receipts;

and a plurality of additional strips overlying said front wall, each of progressively less height than said front wall; and secured thereto along their sides and bottom to the sides and bottom of said front wall;

a pair of the outermost strips being secured intermediate their ends to the next adjacent inner strip to thereby provide a series of cooperating open top pockets for the selective storage from the top to the bottom of said front wall respectively of foreign currency, U.S. currency, items pending, personal I.D., driver's license, business and credit cards and parking tickets.

* * * * *